US009632451B2

(12) United States Patent
Hayashi et al.

(10) Patent No.: US 9,632,451 B2
(45) Date of Patent: Apr. 25, 2017

(54) DEVELOPING APPARATUS, PROCESS CARTRIDGE AND UNIT

(71) Applicant: CANON KABUSHIKI KAISHA, Tokyo (JP)

(72) Inventors: Naoki Hayashi, Kawasaki (JP); Yosuke Kashiide, Tokyo (JP); Masaaki Sato, Yokohama (JP); Fuyuki Sugihara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/019,647

(22) Filed: Sep. 6, 2013

(65) Prior Publication Data

US 2014/0072327 A1 Mar. 13, 2014

(30) Foreign Application Priority Data

Sep. 13, 2012 (JP) ..... 2012-201852

(51) Int. Cl.
*G03G 15/08* (2006.01)
*G03G 21/18* (2006.01)

(52) U.S. Cl.
CPC ..... *G03G 15/0817* (2013.01); *G03G 15/0815* (2013.01); *G03G 21/1832* (2013.01)

(58) Field of Classification Search
CPC ..... G03G 15/0815; G03G 15/0817; G03G 21/1828; G03G 21/1832; G03G 21/1642; G03G 21/1676; G03G 21/1817; G03G 21/1821; G03G 2215/0872; G03G 2221/163; G03G 2221/1651; G03G 2221/1853
USPC ..... 399/102, 103, 105, 119, 274, 284
See application file for complete search history.

(56) References Cited

U.S. PATENT DOCUMENTS

| | | | |
|---|---|---|---|
| 5,331,373 | A | 7/1994 | Nomura et al. |
| 5,452,056 | A | 9/1995 | Nomura et al. |
| 5,528,341 | A | 6/1996 | Shishido et al. |
| 5,585,889 | A | 12/1996 | Shishido et al. |
| 5,870,654 | A | 2/1999 | Sato et al. |
| 5,911,096 | A | 6/1999 | Batori et al. |
| 5,940,658 | A | 8/1999 | Yokoi et al. |
| 5,966,566 | A | 10/1999 | Odagawa et al. |

(Continued)

FOREIGN PATENT DOCUMENTS

| | | | |
|---|---|---|---|
| JP | 2003-214540 | A | 7/2003 |
| JP | 2004-101669 | A | 4/2004 |

(Continued)

*Primary Examiner* — Benjamin Schmitt
(74) *Attorney, Agent, or Firm* — Fitzpatrick, Cella, Harper & Scinto

(57) ABSTRACT

A developing device includes first and second frames; a developer carrying member; an end portion seal, provided in the first frame, for sealing between an end portion and the first frame to prevent leakage; a sheet, provided in the second frame in contact with the developer carrying member along the rotation axial direction of the developer carrying member; a filler filling a space defined by the first and second frames, the end portion seal and the sheet at a connecting portion where the end portion seal and the sheet contact each other; and a projected portion provided in the first frame and projected into the space, the projected portion is spaced from the second frame, the end portion seal in the rotation axial direction.

24 Claims, 15 Drawing Sheets

(56) References Cited

U.S. PATENT DOCUMENTS

| | | | | |
|---|---|---|---|---|
| 5,974,288 | A | 10/1999 | Sato | |
| 6,075,957 | A | 6/2000 | Batori et al. | |
| 6,104,894 | A | 8/2000 | Sato et al. | |
| 6,131,007 | A | 10/2000 | Yamaguchi et al. | |
| 6,185,390 | B1 | 2/2001 | Higeta et al. | |
| 6,188,856 | B1 | 2/2001 | Sato | |
| 6,381,420 | B1 | 4/2002 | Sato et al. | |
| 6,505,020 | B1 * | 1/2003 | Higeta et al. | 399/109 |
| 6,640,066 | B2 | 10/2003 | Sato | |
| 6,714,749 | B2 | 3/2004 | Sato et al. | |
| 6,895,199 | B2 | 5/2005 | Sato et al. | |
| 6,898,399 | B2 | 5/2005 | Morioka et al. | |
| 6,937,832 | B2 | 8/2005 | Sato et al. | |
| 7,149,457 | B2 | 12/2006 | Miyabe et al. | |
| 7,155,140 | B2 | 12/2006 | Arimitsu et al. | |
| 7,155,141 | B2 | 12/2006 | Sato et al. | |
| 7,158,736 | B2 | 1/2007 | Sato et al. | |
| 7,200,349 | B2 | 4/2007 | Sato et al. | |
| 7,218,882 | B2 | 5/2007 | Toba et al. | |
| 7,224,925 | B2 | 5/2007 | Sato et al. | |
| 7,283,766 | B2 | 10/2007 | Arimitsu et al. | |
| 7,349,657 | B2 | 3/2008 | Sato et al. | |
| 7,412,193 | B2 | 8/2008 | Sato et al. | |
| 7,483,646 | B2 | 1/2009 | Ueno et al. | |
| 7,499,663 | B2 | 3/2009 | Sato et al. | |
| 7,660,550 | B2 | 2/2010 | Mori et al. | |
| 7,689,146 | B2 | 3/2010 | Sato et al. | |
| 7,720,408 | B2 | 5/2010 | Ueno et al. | |
| 7,813,668 | B2 | 10/2010 | Ueno et al. | |
| 7,983,589 | B2 | 7/2011 | Sato et al. | |
| 8,301,056 | B2 | 10/2012 | Matsushita et al. | |
| 8,422,914 | B2 | 4/2013 | Hayashi et al. | |
| 8,583,001 | B2 | 11/2013 | Kubo et al. | |
| 2011/0020031 | A1 | 1/2011 | Sato et al. | |
| 2011/0233813 | A1 * | 9/2011 | Ikeda et al. | 264/145 |
| 2013/0209137 | A1 | 8/2013 | Hayashi et al. | |
| 2013/0308971 | A1 | 11/2013 | Kashiide et al. | |
| 2014/0064776 | A1 | 3/2014 | Yamasaki et al. | |
| 2014/0064784 | A1 | 3/2014 | Hayashi et al. | |
| 2014/0086620 | A1 | 3/2014 | Takeuchi et al. | |

FOREIGN PATENT DOCUMENTS

| | | | |
|---|---|---|---|
| JP | 2004-125930 | A | 4/2004 |
| JP | 2005-043536 | A | 2/2005 |
| JP | 2006-251145 | A | 9/2006 |

* cited by examiner (a)

(b)

(a)

(b)

DEVELOPING APPARATUS, PROCESS CARTRIDGE AND UNIT

FIELD OF THE INVENTION AND RELATED ART

The present invention relates to a development apparatus (device) and unit which are employed by an image forming apparatus, and a process cartridge which is removably installable in the main assembly of an image forming apparatus.

An electrophotographic image forming apparatus such as a printer, etc., which uses an electrophotographic process, forms a latent image by uniformly charging an electrophotographic photosensitive component, which is an image bearing component, and selectively exposing various points of the uniformly charged portions of the electrophotographic photosensitive component. Then, it develops the latent image into a visible image, that is, an image formed of developer, with the use of developer, and transfers the visible image onto recording medium. Then, it fixes the transferred image formed of developer to the recording medium, by applying heat and pressure to the image formed of developer, to permanently record an image on the recording medium. An electrophotographic image forming apparatus such as the one described above needs to be supplied with developer, and also, the various processing means it has need to be maintained. Thus, there have been known image forming apparatuses which employ the so-called process cartridge system as a means for simplifying the operation for supplying an image forming apparatus with developer, and also, the operation for maintaining the various processing means. A process cartridge is a cartridge which is removably installable in an electrophotographic image forming apparatus, and in which one or more among an electrophotographic photosensitive component, charging means, developing means, cleaning means, etc., are disposed together. A process car bridge system enables a user to maintain an electrophotographic image forming apparatus by simply replacing a process cartridge. Thus, it drastically improves an image forming apparatus in operability. That is, a user can replace a process cartridge by removing a process cartridge, the service life of which had expired, from the main assembly of an image forming apparatus, and installing a new process cartridge in the main assembly.

The development apparatus (device) in a process cartridge such as the one described above is provided with development end seals, which are attached to the lengthwise ends of its developer bearing component which is rotatably supported by the frame of the development devise to prevent the developer in the development device from leaking out of the development device. It is also provided with a flexible sheet for preventing the developer from leaking through the gap between the development device frame and developer bearing component. The flexible sheet is disposed in contact with the peripheral surface of the developer hearing component and extends in the direction parallel to the axial line of the developer bearing component. The development end seals and flexible sheet are attached to the development device frame with the use of adhesive. Further, the gaps between the development device frame and end seals, and the gape between the development device and flexible sheer, are filled with filler, to prevent the developer from leaking through these gaps. There have been known various structural arrangements for filling the gaps between the development device frame and end seals, and the gaps between the development device frame and flexible sheet. One of them is disclosed in Japanese Laid-open Patent Application 2003-214540.

In the case of a structural arrangement such as the above-mentioned one, the errors which might occur during the manufacturing of the development end seals, and the errors which might occur during the assembly of a process cartridge, are taken into consideration, in order to prevent the development end seals from extending beyond the edges of the development end seal rearing surface. More concretely, the development end seal bearing surface is made greater in width than the development end seal to provide development end seal bearing surface with a margin large enough for preventing the development end seals from extending beyond the edges of development end seal bearing surface. The gaps which result from the provision of the margin are filled with filler.

However, if the above described margin with which development end seal bearing surface is provided is excessive, the gaps, which have to be filled with filler, also become excessive. In order to fill these excessive gaps in a single step, the amount of pressure to be applied to fill the gaps has to be substantial, since the amount of filler to be injected into the gaps is substantial. Thus, it is possible that the filler will ooze beyond the flexible sheet. If the filler oozes beyond the flexible sheet, it is possible that the filler will adhere to the developer bearing component, which in turn will cause an image forming apparatus to output an unsatisfactory image. As a solution to this problem, it is possible to inject the filler in several steps in which the filler is injected by a smaller amount to make it unnecessary to apply high pressure to the filler. However, this increases a process cartridge in the number of manufacturing steps, which leads to an increase in the cost of manufacturing a process cartridge.

SUMMARY OF THE INVENTION

Thus, the primary object of the present invention is to provide a development apparatus (device) which is significantly superior to any development apparatus (device) in accordance with the prior art, in terms of the level of perfection at which the gaps between the development apparatus (device) frame and the development end seals of the development apparatus (device), and the gap between the development apparatus (device) frame and flexible sheet of the apparatus (device) are filled with filler.

According to an aspect of the present invention, there is provided a developing device for use with an image forming apparatus, said developing device comprising a first frame; a second frame; a developer accommodating portion tor accommodating a developer formed by connecting said first frame and said second frame with each other; a developer carrying member for developing a latent image formed on a image bearing member using the developer accommodated in said developer accommodating portion; an end portion scaling member, provided in said first frame, for sealing between an end portion and said first frame to prevent leakage of the developer from said developer accommodating portion at the end portion with respect to a rotation axial direction of said developer carrying member; a sheet, provided in said second frame in contact with said developer carrying member along the rotation axial direction of said developer carrying member, for preventing leakage of the developer from said developer accommodating portion; a filler for preventing leakage of the developer from said developer accommodating portion, said filler filling a space defined by said first frame, said second frame, said end portion sealing member and said sheet at a connecting portion where said end portion sealing member and said sheet contact each other; and a projected portion provided in said first frame and projected into the space, said projected portion is spaced from said second frame, said end portion sealing member in the rotation axial direction.

According to another aspect of the present invention, there is provided a process cartridge detachable mount able to a main assembly of an image forming apparatus, said process cartridge comprising an image bearing member; a first frame; a second frame; a developer accommodating portion for accommodating a developer formed by connecting said first frame and said second frame with each other; a developer carrying member for developing a latent image formed on said image bearing member using the developer accommodated in said developer accommodating portion; an end portion sealing member, provided in said first frame, for sealing between an end portion and said first frame to prevent leakage of the developer from said developer accommodating portion at the end portion with respect to a rotation axial direction of said developer carrying member; a sheet, provided in said second frame in contact with said developer carrying member along the rotation axial direction of said developer carrying member, for preventing leakage or the developer from said developer accommodating portion; a filler for preventing leakage of the developer from said developer accommodating portion, said filler filling a space defined, by said first frame, said second frame, said end portion sealing member and said sheet at a connecting portion where said end portion sealing member and said sheet contact each other; and a projected portion provided in said first frame and projected into the space, said projected portion is spaced from said second frame, said end portion sealing member in the rotation axial direction.

According to a further aspect of the present invention, there is provided a unit for use with an image forming apparatus, said unit comprising a first frame; a second frame; a developer accommodating portion for accommodating a developer formed by connecting said first frame and said second frame with each other; a rotatable member for carrying a developer; an end portion sealing member, provided in said first frame, for sealing between an end portion and said first frame to prevent leakage of the developer from said developer accommodating portion at the end portion wish respect to a rotation axial direction of said rotatable member; a sheet, provided in said second frame in contact with said rotatable member along the rotation axial direction of said rotatable member, for preventing leakage of the developer from said developer accommodating portion; a filler for preventing leakage of the developer from said developer accommodating portion, said filler filling a space defined by said first frame, said second frame, said end portion sealing member and said sheet at a connecting portion where said end portion sealing member and said sheet contact each other; and a projected portion provided in said first frame and projected into the space, said projected portion is spaced from said second frame, said end portion sealing member in the rotation axial direction.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1A:
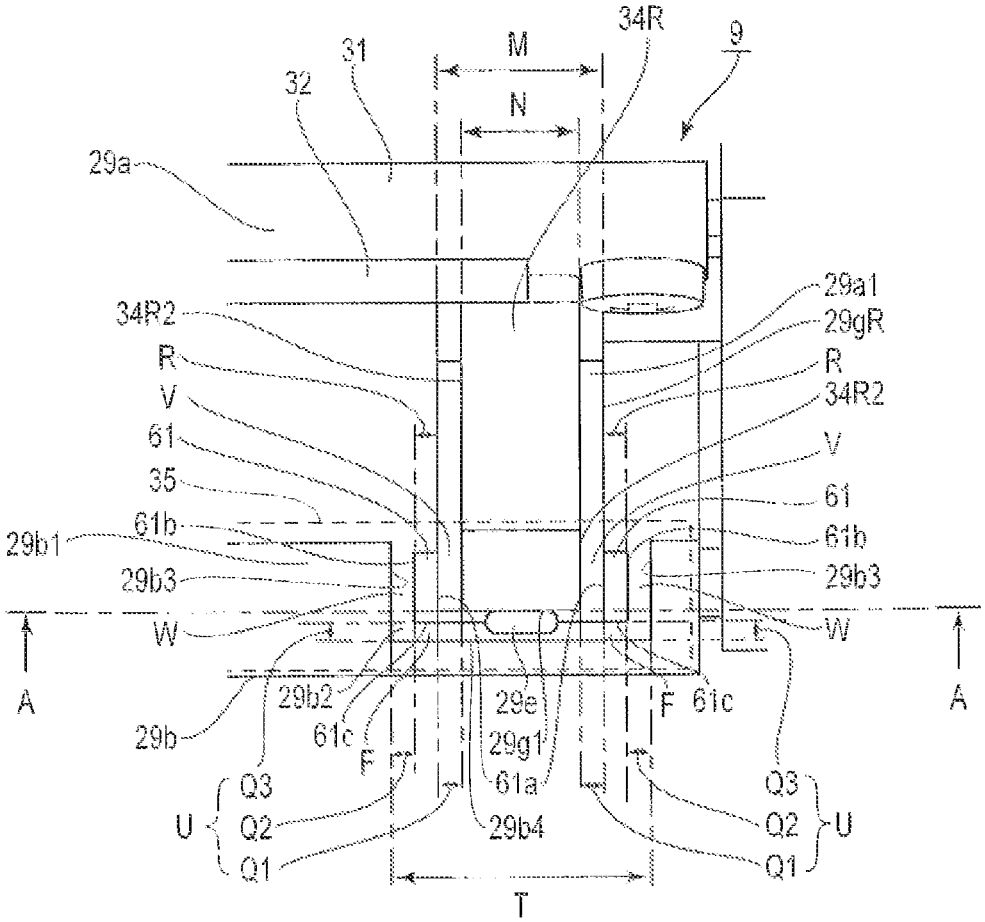
FIGS. 1A and 1B are enlarged views of one of the lengthwise end portions of the frame of the development device in the first embodiment of the present invention.

Hereinafter, the present invention is described with reference to an embodiment of the present invention. However, the embodiment is not intended to limit the present invention in terms of the measurements, materials, shapes of the structural components of an electrophotographic image forming apparatus, and also, in terms of the positional relationship among the structural components. That is, they are to be modified in accordance with an apparatus to which the present invention is applied, and the condition under which the apparatus is used.

The present invention relates to a development apparatus (device) employed by an electrophotographic image forming apparatus such as a copying machine, a printer, and the like, which employ an electrophotographic image formation method. Here, an electrophotographic image forming apparatus means an apparatus which forms an image on recording medium with the use of an electrophotographic image formation method. As examples of an electrophotographic image forming apparatus, there can be included an electrophotographic copying machine, an electrophotographic printer (laser beam printer, LED printer, etc., for example), a facsimile machine, a word processor, etc. A development apparatus (device) is an integrated combination of developing means used for developing an electrostatic latent image on an electrophotographic photosensitive component. It is built as a part of an electrophotographic image forming apparatus, or in the form of a development cartridge which is removably installable in an electrophotographic image forming apparatus. A development cartridge is a cartridge which has at least a developer bearing component (development roller) and is removably installable in the main assembly of the apparatus. A process is a cartridge in which an electrophotographic photosensitive member as an image bearing component, and at least one processing means, that is, charging means, developing means, and/or cleaning means, are integrally disposed, and which is removably installable in the main assembly of the apparatus.

Embodiment

The image forming apparatus in the following embodiment of the present invention is a full-color image forming apparatus in which four process cartridges which include a development device are removably installable. However, the following embodiment is not intended to limit the present invention in the number of process cartridges removably installable in an image forming apparatus. The number is to be set as necessary. For example, in the case of an image forming apparatus for forming a monochromatic image, the number of process cartridges to be installed in the apparatus is one.

The image forming apparatus in the following embodiment of the present invention is a printer. However, the embodiment is not intended to limit the present invention in the type of an image forming apparatus to which the present invention is applicable. That is, the present invention is also applicable to image forming apparatuses other than the one in the following embodiment. That is, the present invention is also applicable to a copying machine, a facsimile machine, etc., and/or a multifunction image forming apparatus capable of performing the functions of two or more of the preceding apparatuses.

<<General Structure of Image Forming Apparatus>>

Figure 2:
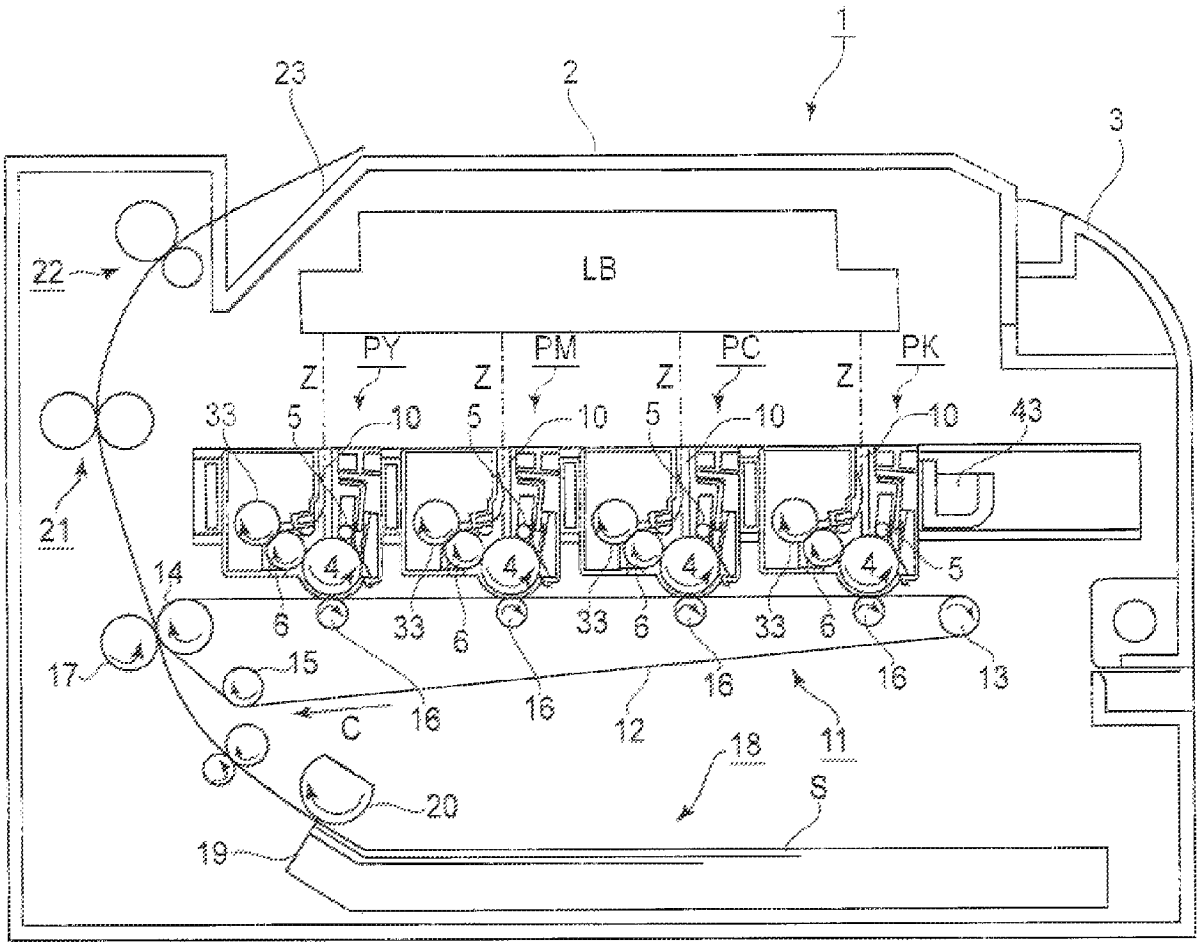
FIG. 2 is a schematic sectional view of the electrophotographic image forming apparatus in the first embodiment.

FIG. 2 is a schematic sectional view of the image forming apparatus in this embodiment. This image forming apparatus 1 is a full-color laser printer which uses an electrophotographic image formation process, and is based on four primary colors. It forms a color image on recording medium. It employs the so-called process cartridge system. That is, it is structured so that process cartridges (which will be referred to simply as cartridges) are removably installable in the main assembly 2 of the image forming apparatus to form a color image on a sheet S of recording medium.

Regarding the direction of the image forming apparatus 1, the side of the image forming apparatus 1, which is provided with a door 3 will be referred to as the front surface, and the opposite surface from the front surface will be referred to as the rear surface. Further, the right and left sides of the image forming apparatus 1, as seen from the front side, will be referred to as the drive side and non-drive side, respectively.

There are disposed in the apparatus main assembly 2, four cartridges P (PY, PM, PC and PK), more specifically, the first, second, third, and fourth cartridges PY, PM, PC and PK, respectively, being horizontally aligned in parallel. The first to fourth cartridges P (PY, PM, PC and PK) have four electrophotographic image processing systems, one for one, which are the same in function, although they are different in the color of the developer (which may be referred to as toner, hereafter) they use. To the first to fourth cartridges P (PY, PM, PC and PK), rotational driving force is transmitted from the driving force output portion (unshown) of she apparatus main assembly 2. Further, to the first to fourth cartridges P (PY, PM, PC and PK), bias voltages (charge bias, development bias, etc.) are supplied from the apparatus main assembly 2.

Figure 3:
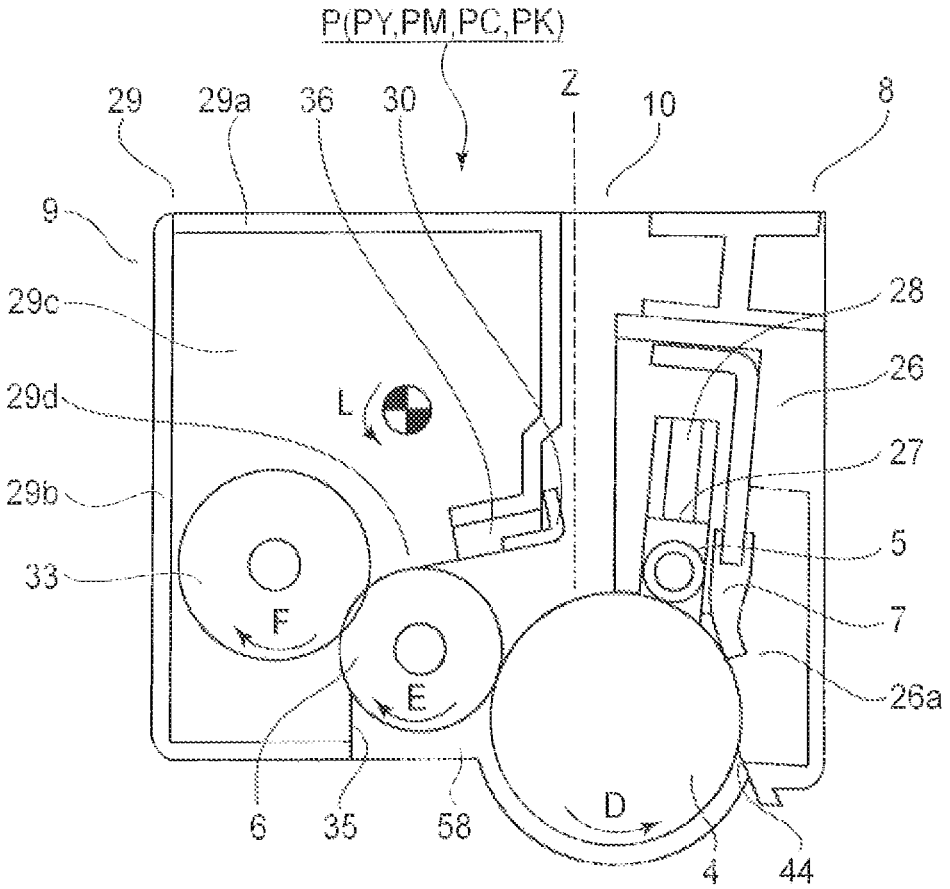
FIG. 3 is a schematic sectional view of the process cartridge in the first embodiment.

FIG. 3 is a schematic sectional view of the process cartridge in this embodiment. Referring to FIG. 3, each of the first to fourth cartridges P (PY, PM, PC and PK) in this embodiment has a photosensitive drum (electrophotographic photosensitive component) 4, and a cleaning unit 8. The cleaning unit 8 is equipped with a charging means as a means which processes the photosensitive drum 4, and a cleaning means. Further, each of the cartridges P (PY, PM, PC and PK) has a development device 9 equipped with a developing means for developing the electrostatic latent image on the photosensitive drum 4. The cleaning unit 8 and development device 9 are in connection to each other. As the charging means, a charge roller 5 is used. As the cleaning means, a cleaning blade 7 is used. As a developing means, a development roller (developer bearing component) 6 is used. The concrete structure of the cartridge is described later.

Referring to FIG. 2, the first, cartridge PY stores toner of yellow (Y) color, in its development frame 29. It forms a toner image of yellow (Y) color on the peripheral surface of the photosensitive drum 4. The second cartridge PM stores toner of magenta (M) color in its development frame 29. It forms a toner image of the M color on its photosensitive drum 4. The third cartridge PC stores toner of cyan (C) color in its development frame 29. It forms a toner image of the cyan (C) color on the peripheral surface of the photosensitive drum 4. The fourth cartridge PK stores toner of black (K) color in its development frame 29. It forms toner image of the black (K) color on the peripheral surface of its photosensitive drum 4.

There is disposed a laser scanner unit LB as exposing means, above the combination of the first to fourth cartridges PY, PM, PC and PK. This laser scanner unit LB outputs a beam Z of laser light while modulating the beam Z according to the information of the image to be formed. The beam Z of laser light scans (exposes) the peripheral surface of the photosensitive drum 4, through an exposure window 10 of one cartridge P.

There is disposed an intermediary transfer belt unit 11, as a transfer component, below the combination of the first to fourth case ridges P (PY, PM, PC and PK). This intermediary transfer belt unit 11 has: a flexible endless belt 12; and a combination of a driver roller 13, a turn roller 14, and a tension roller 15, by which the endless belt 12 is suspended and kept tensioned. The photosensitive drum 4 in each of the cartridges P (PY, PM, PC and PK) is in contact with the top surface of the belt 12, by the downwardly facing portion of its peripheral surface. The area of contact between the photosensitive drum 4, and the belt 12, is the primary transfer station. There are disposed the primary transfer rollers 16 in the inward side of the loop which the transfer belt 12 forms, in such a manner that they are pressed against the photosensitive drums 4 one for one, with the presence of the belt 12 between them and photosensitive drums 4. Against the turn roller 14, the secondary transfer roller 17 is kept pressed, with the presence of the transfer belt 12 between the turn roller 14 and secondary transfer roller 17. The area of contact between the secondary transfer roller 17 and belt 12 is the secondary transfer station.

There is disposed a sheet feeding/conveying unit 18 below the intermediary transfer belt unit 11. This sheet feeding/conveying unit 18 has: a sheet feeder tray 19, in which multiple sheets S of recording medium are stored in layers; and a sheet feeder roller 20. There is disposed in the top rear section of the apparatus main assembly 2, a fixation unit 21 and a discharge unit 22. A part of the top surface of the apparatus main assembly 2 is used as a delivery tray 23. To the sheet S of recording medium, a toner image is fixed by the fixing means with which the fixation unit 21 is provided. Then, the sheet S is discharged into the delivery tray 23.

<<Image Forming Operation>>

The operation for forming a full-color image is as follows: The photosensitive drum 4 in each of the first to fourth cartridges P (PY, PM, PC and PK) is rotationally driven at a preset speed in the counterclockwise direction in FIG. 2 (direction indicated by arrow mark D in FIG. 3). Next, referring to FIG. 2, the transfer belt 12 is circularly driven in such a direction that the moving direction of the belt 12 becomes the same as the rotational direction of the photosensitive drum 4 (indicated by arrow mark C), at a speed which corresponds to the speed of the photosensitive drum 4.

The laser scanner unit LB also is driven. In synchronism with this driving of the laser scanner unit LB, the charge roller 5 in each cartridge P uniformly charges the peripheral surface of the photosensitive drum 4 to preset polarity and a preset potential level. The laser scanner unit LB scans (exposes) the peripheral surface of the photosensitive drum 4 with the beam Z of laser light it outputs while modulating the beam Z with the image formation signals which correspond one for one to the monochromatic toner images, different in color, into which the original has been separated. Consequently, an electrostatic latent image, which reflects the image formation signals of the corresponding color is formed on the peripheral surface of the photosensitive drum 4. The formed electrostatic latent image is developed by the development roller 6, which is being rotationally driven at a preset speed (clockwise direction in FIG. 2; direction indicated by arrow mark E in FIG. 3).

Through the electrophotographic image formation process described above, a toner image of the yellow color, which corresponds to the yellow color component of the full-color image is formed on tire photosensitive drum 4 of the first cartridge PY. Then, the toner image is transferred (primary transfer) onto the transfer belt 12. Similarly, on the peripheral surface of the photosensitive drum 4 of the second cartridge PM, a toner image of the magenta color, which corresponds to the magenta color component of the full-color image is formed. Then, the toner image of the magenta color is transferred (primary transfer) onto the transfer belt 12 in such a manner that it is laid upon the toner image of the yellow color, which has oust been transferred (primary transfers onto the transfer belt 12. Further, on the peripheral surface of the photosensitive drum 4 of the third cartridge PC, a toner image of the cyan color, which corresponds to the cyan color component of the full-color image is formed. Then, the toner image is transferred (primary transfer) onto the transfer belt 12 in such a manner that it is laid upon the combination of the toner image of the yellow color, and the toner image of the magenta color, which have just been transferred, (primary transfer) onto the transfer belt 12. Further, on the peripheral surface of the photosensitive drum 4 of the fourth cartridge PK, a toner image of the black color, which corresponds to the black color component of the full-color image, is formed. Then, the toner image is transferred (primary transfer) onto the transfer belt 12 in such a manner that it is laid upon the combination of the yellow, magenta, and cyan color images, which have just been, transferred (primary transfer) onto the transfer belt 12.

Consequently, an unfixed full-color image is synthetically effected on the transfer belt 12, by the toner images of the yellow, magenta, cyan and black colors.

Meanwhile, the sheets S of recording medium begin to be conveyed one by one while being separated from the rest. Then, each sheer S is introduced into the secondary transfer station, which is the area of contact between the secondary transfer roller 17 and transfer belt 12. Thus, the four toner images, different in color, layered on the transfer belt 12 are transferred together onto the surface of the sheer S while the sheet S is conveyed through the secondary transfer station, as if they are peeled away from the transfer belt 12.

<<Structure of Cartridge>>

Figure 4:
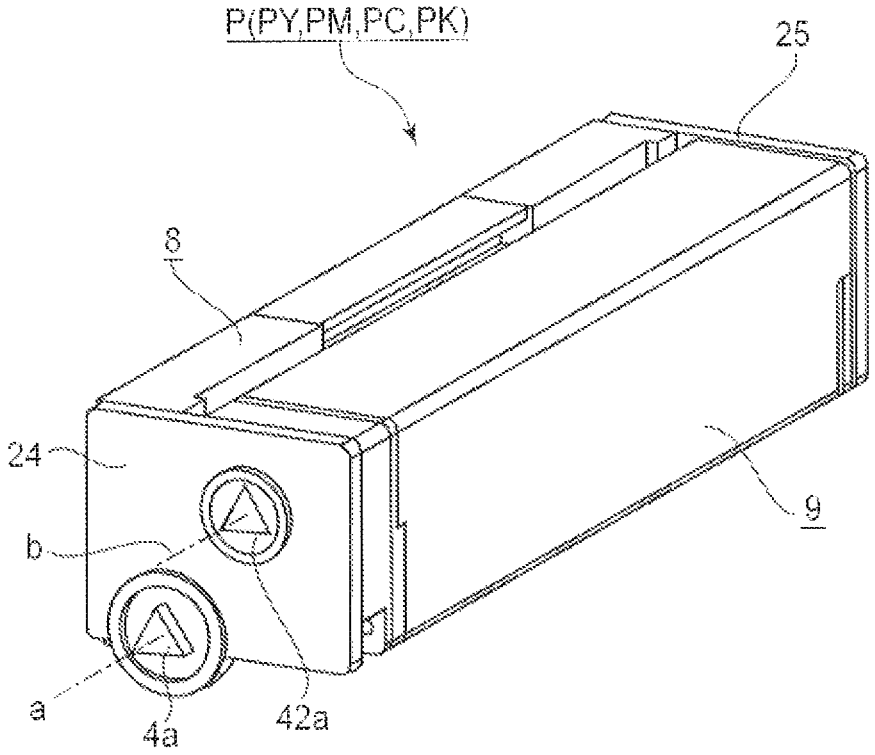
FIG. 4 is a perspective view of the process cartridge in the first embodiment.

FIG. 4 is a perspective view of the process cartridge in this embodiment. As is evident from FIG. 4, the cartridges P (PY, PM, PC and PK) are roughly in the form of a rectangle parallelepiped, the lengthwise direction of which is parallel to the direction of the relational axis a of the photosensitive drum 4 (which may be referred to simply as lengthwise direction, hereafter). Each cartridge P has a cleaning unit 8, a development device 9, a cover 24 on the drive side, a cover 25 on the non-drive side. The cleaning unit 8 has the photosensitive drum 4, charge roller 5, and a cleaning means container 26 having a cleaning blade 7.

Referring to FIG. 4, the photosensitive drum 4 is rotatably supported by the drive side cover 24 and non-drive side cover 25. It rotates (in direction indicated by arrow mark D in FIG. 3) by obtaining the driving force or the motor (unshown) of the apparatus main assembly 2 through the drum drive coupling 4*a*. Next, referring to FIG. 3, the charge roller 5 is rotatably supported by the pair of charge roller bearings 27 of the cleaning device container 26, by its lengthwise end portions. It is kept in contact with the peripheral surface of the photosensitive drum 4, being thereby rotated by the rotation of the photosensitive drum 4. It charges the peripheral surface of the photosensitive drum 4 by being supplied with charge bias. In order to ensure that the peripheral surface of the photosensitive drum 4 is uniformly charged, the lengthwise ends of the charge roller 5 are pressed upon the peripheral surface of the photosensitive drum 4, by a pair of compression springs 28, one for one.

The cleaning blade 7 is fixed to the cleaning device container 26, and is placed in contact with the peripheral surface of the photosensitive drum 4 in such an attitude that its cleaning edge made of elastic rubber is placed in contact with the peripheral surface of the photosensitive drum 4 in the counter direction relative to the rotational direction (direction indicated by arrow mark D in FIG. 3). The cleaning blade 7 cleans the peripheral surface of the photosensitive drum 4 by scraping away the transfer residual toner remaining en the peripheral surface of the photosensitive drum 4. In order to ensure that the transfer residual toner is completely scraped away, the cleaning edge of the cleaning blade 7 is kept pressed upon the peripheral surface of the photosensitive drum 4 with the application of a preset amount of pressure.

Further, the transfer residual toner scraped away from the peripheral surface of the photosensitive drum 4 by the cleaning blade 7 is stored as waste toner, in the waste toner storage 26*a* of the cleaning device container 26. Therefore, the cleaning device container 26 is provided with a waste toner recovery sheet 44 for preventing the waste toner from leaking out of the container 26 through the gap between the photosensitive drum 4 and container 26, and the gap between the container 26 and cleaning blade 7. The waste toner recovery sheet 44 is positioned so that it extends in the lengthwise direction of the photosensitive drum 4. Further, the lengthwise end portions of the cleaning blade 7 are provided with a pair of cleaning blade end seals (unshown) one for one.

In this embodiment, the photosensitive drum 4, and the processing means for processing the photosensitive drum 4, more specifically, the charge roller 5 as a charging means, cleaning blade 7 as a cleaning means, and waste toner storage 26*a*, are unitized as a cartridge. However, this embodiment is not intended to limit the present invention, in terms of the cartridge configuration. For example, one or more among the photosensitive drum 4, developing means, charging means, and cleaning means, may be unitized in the form of cartridge, so that they can be removably installable in the apparatus main assembly 2.

<<Structural Arrangement for Allowing Cartridge to be Removably Installed>>

Figure 5:
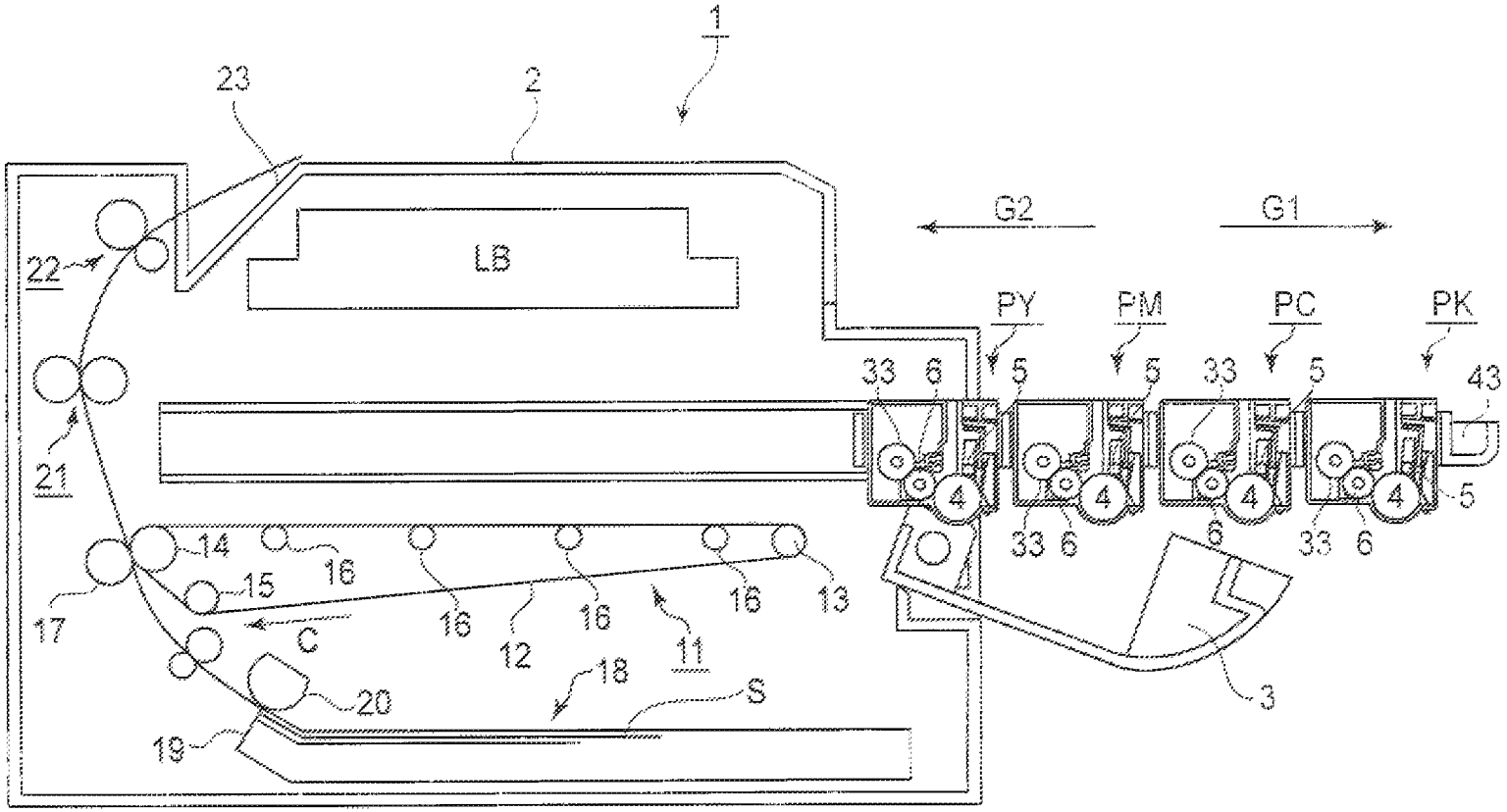
FIG. 5 is a schematic sectional view of the image forming apparatus in the first embodiment, which is in the state in which the process cartridges can be placed in, or removed from, the cartridge tray of the image forming apparatus.
Figure 6:
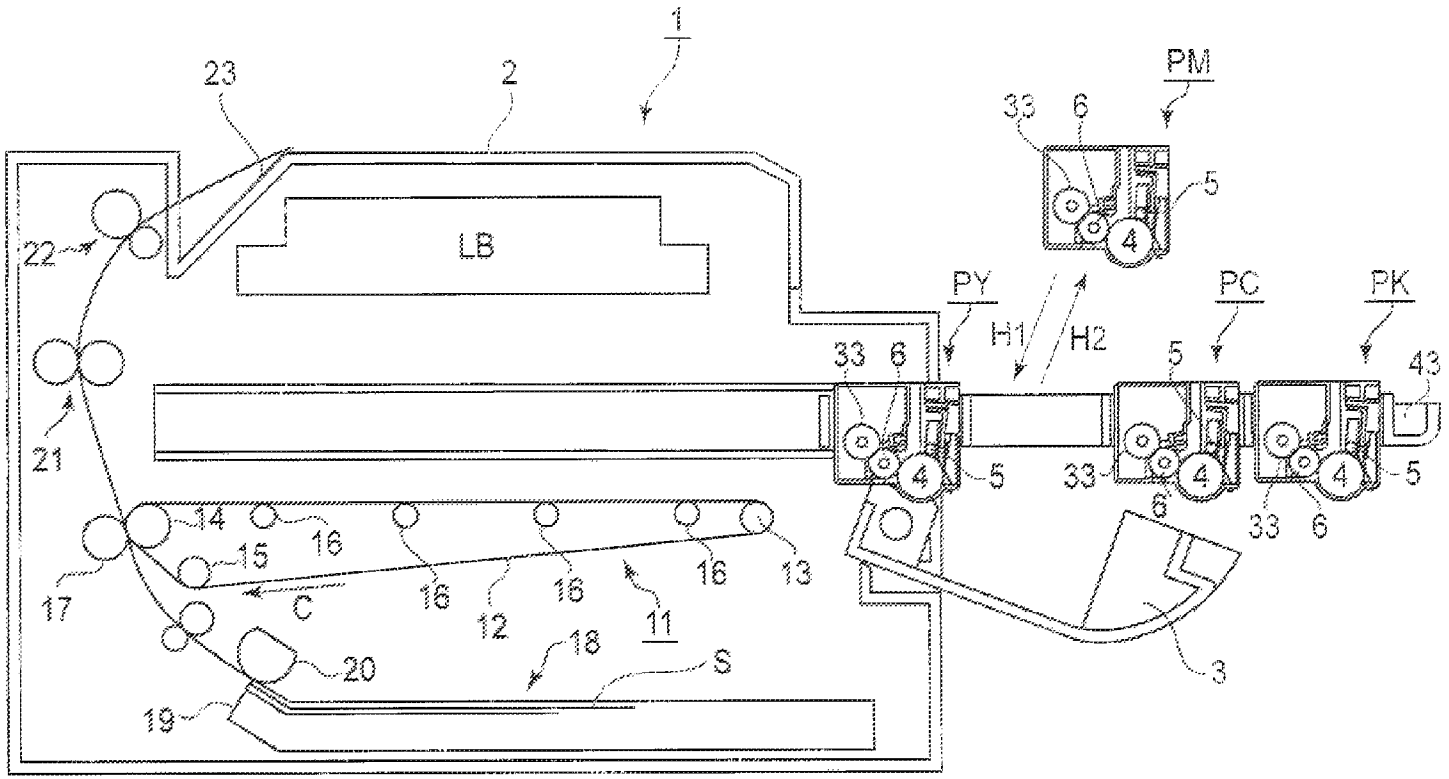
FIG. 6 is a schematic sectional view of the image forming apparatus in the first embodiment, and shows the operation for mounting or dismounting a process cartridge.

Next, referring to FIGS. 5 and 6, the operation for installing the cartridge P (PY, PM, PC or PK) into the apparatus main assembly 2, or removing the cartridge P from the apparatus main assembly 2, is described. FIG. 5 is a schematic sectional view of the image forming apparatus 1 when the cartridge tray 43 is in the outermost position into which the cartridge tray 43 can be pulled out, and in which the cartridges can be placed in, or removed from, the cartridge tray 43. FIG. 6 is a schematic sectional view of the image forming apparatus 1, which shows the operation for installing a cartridge into the cartridge tray 43, or removing a cartridge from the cartridge tray 43.

The apparatus main assembly 2 is provided with the cartridge tray 43 in which the cartridges P (PY, PM, PC and PK) are removably placeable. Referring to FIG. 5, the apparatus main assembly 2 is structured, so that the cartridge tray 23 is linearly movable (can be pushed into, or pulled out of, apparatus main assembly 2) in the directions G1 and G2, which are practically parallel to the horizontal direction of the apparatus main assembly 2. The cartridge tray 43 can be positioned in its cartridge tray home position which is in the apparatus main assembly 2, and the outermost positioned into which the cartridge tray 43 can be pulled out of the apparatus main assembly 2.

First, the operation for installing the cartridges P (PY, PM, PC and PK) into the apparatus main assembly 2 is described. Referring to FIG. 5, to begin with, a user (operator) is to open the apparatus door 3, and move the cartridge tray 43 in the direction indicated by the arrow mark G1, so that the cartridge tray 43 will be in its outermost position. It is when the cartridge tray 43 is in the state shown in FIG. 6 that the cartridge can be mounted into the cartridge tray 43 in the direction indicated by an arrow mark H1 in FIG. 6 to be held in the tray 43. Then, the cartridge tray 43 in which the cartridges P are held is to be moved in the direction indicated by an arrow mark G2 in FIG. 5, so that the cartridge tray 43 will be positioned in its home position in the apparatus main assembly 2. Then, the uses is to close the door 3 to end the installation of the cartridges P into the apparatus main assembly 2 (FIG. 2).

Next, the operation for removing the cartridge P (PY, PM, PC and PK) from the apparatus main assembly 2 is described. Referring to FIG. 5, the user is to move the cartridge tray 43 into the cartridge removal position, or the outermost position, in the same manner as the manner in which the cartridge tray 43 is moved to install the cartridge P into the apparatus main assembly 2. It is when the cartridge tray 43 is in the state shown in FIG. 6 that the cartridge P can be removed from the cartridge tray 43 in the direction indicated by an arrow mark H2 in FIG. 6 to complete the operation for removing the cartridge P from the apparatus main assembly 2. That is, the cartridges P are removably installable in the apparatus main assembly 2 through the above described operations.

<<Structure of Development Device>>

Figure 7:
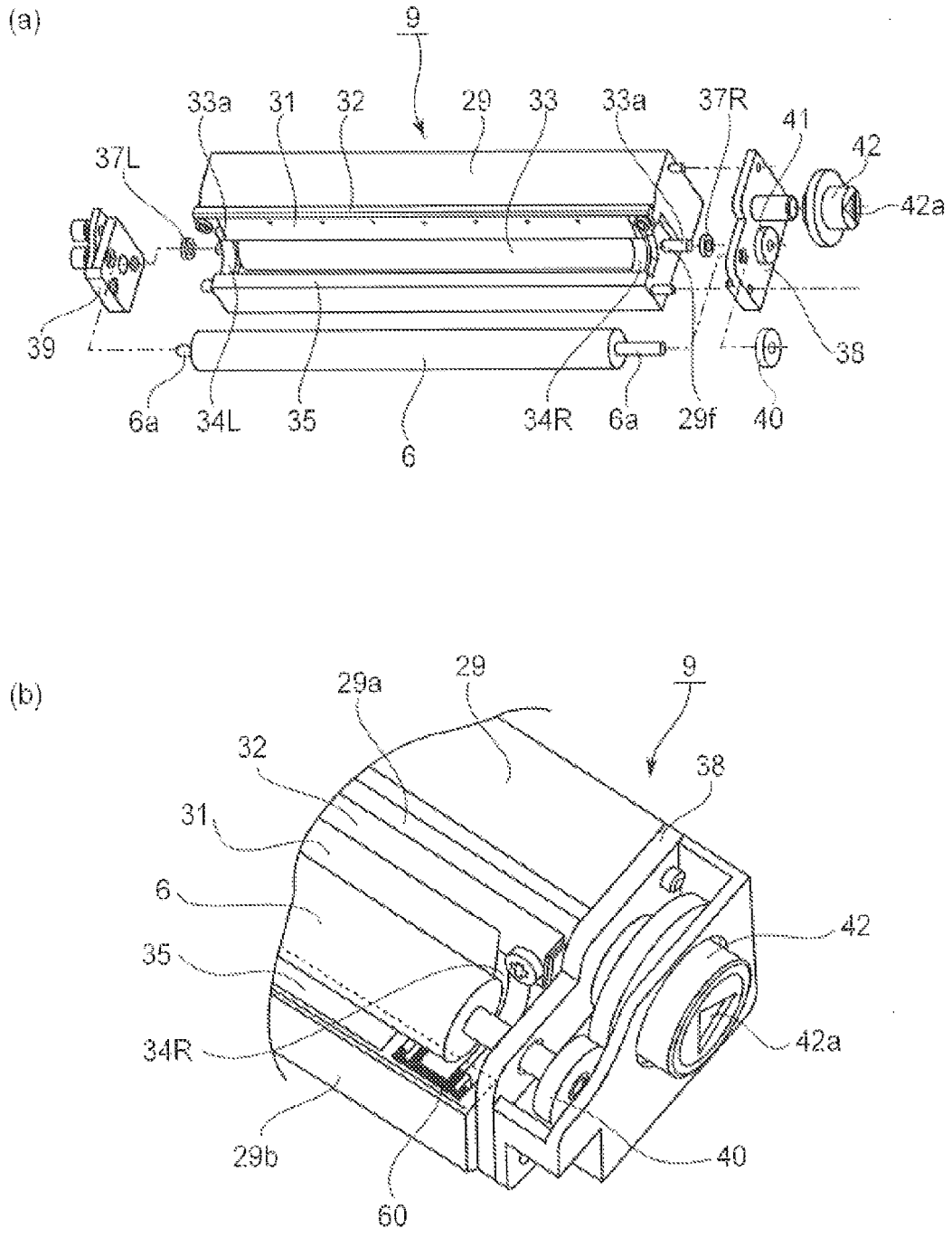
FIG. 7 is an exploded perspective view of the development device in the first embodiment.
Figure 9:
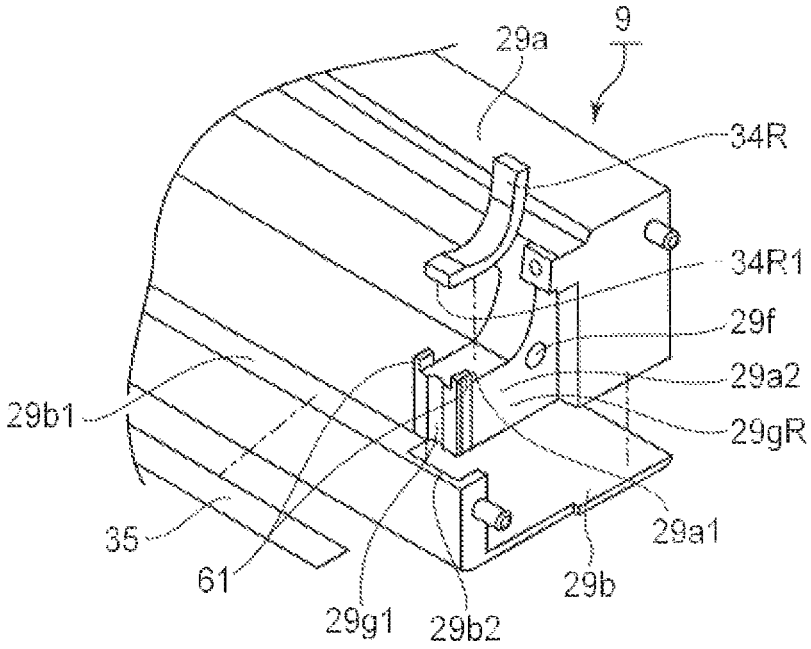
FIG. 9 is an enlarged perspective view of the one of the lengthwise end portions of the frame of the development device in the first embodiment.
Figure 9:
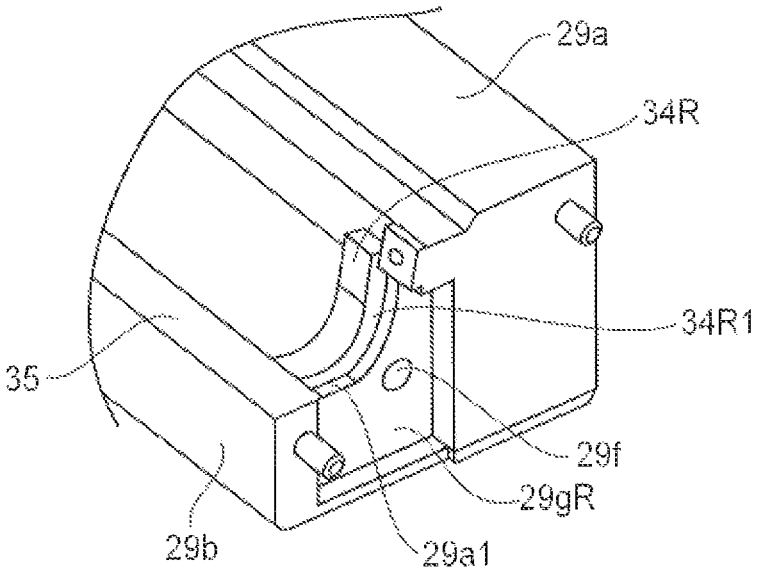

Next, referring to FIGS. 3, 7(*a*), 7(*b*), 9(*a*) and 9(*b*), the structure of the development device 9 in this embodiment are described. FIG. 7(*a*) is an exploded perspective view of the development device 9 in this embodiment, and FIG. 7(*b*) is an enlarged perspective view of the development end seal 34R and its adjacencies, on the drive side of the development device 9 in this embodiment. FIG. 9(*a*) is an enlarged, exploded, and perspective view of the lengthwise end portion (having development end seal 34R) of the development device 9 in this embodiment, and FIG. 9(*b*) is an enlarged perspective view of the lengthwise end portion (having development end seal 34R) of the development device 9 in this embodiment.

Referring to FIGS. 4 and 7(*a*), the development device 9 is in the form of a rectangular parallelepiped, the lengthwise direction of which is parallel to the direction of the rotational axis of the development roller 6 as a developer bearing member. The development device 9 has a development frame 29, a development blade 31, a developer supply roller 33, a pair of developer end seals 34R and 34L, a flexible sheet 35, and a pair of supply roller shaft, seals 37R and 37L, in addition to the development roller 6.

Referring to FIGS. 3, 9(*a*) and 9(*b*), the development frame 29 is made up of the first frame 29*a* to which the developer supply roller 33 and development end seals 34R and 34L are attached, and a second frame 29*b* to which the flexible sheet 35 is attached. The first and second frames 29*a* and 29*b* are welded to each other by ultrasonic welding or the like, whereby the toner storage chamber 29*c* in which toner is stored, and an opening 29*d* through which toner is released from the toner storage chamber 29*c*, are created. The structure of the first frame 29*a* and structure of the second frame 29*b* are described later in detail.

In order to enable the development roller 6 to bear the toner discharged from the toner storage chamber 29*c* which is a developer storage, the development roller 6 is positioned so that it extends from one end of the opening 29*d* to the other in terms of the lengthwise direction. Further, the developer supply roller 33 is positioned so that it hypothetically invades into the development roller 6 in the radius direction of the developer supply roller 33. Next, referring to FIG. 6(*a*), the core 5*a* of the development roller 6, and the core 33*a* of the developer supply roller 33, are rotatably supported by the drive side bearings 38 and non-drive side bearings 39 attached to the lateral walls of the development frame 29, one for one, by their lengthwise ends.

The drive side end of the core 6*a* of the development roller 6 is fitted with a development roller near 40, and the drive side end of the core 33*a* of the developer supply roller 33 is fitted with a developer supply roller gear 41. The development roller gear 40 and developer supply roller gear 41 are in mesh with the development drive input gear 42. The development drive input gear 42 is provided with a development drive coupling 42*a*, with which the drive output coupling (unshown) with which the apparatus main assembly 2 is provided is in engagement to transmit the driving force of the motor (unshown) to the development drive coupling 42*a* to rotationally drive the development roller 6 and developer supply roller 33 at a preset speed.

The development blade 31 is a piece of thin and elastic metallic plate, which is roughly 0.1 mm in thickness. It is positioned so that its free edge in terms of its widthwise direction is placed in contact with the development roller 6 in the counter direction relative to the rotational direction (indicated by arrow mark E in FIG. 3) of the development roller 6. It regulates in thickness the toner layer on the development roller 6. Further, referring to FIG. 3, the development blade bottom seal 36 (developer layer thickness regulation component bottom seal) 36 is positioned so that it fills the gap between the development frame 29 and development blade unit 30, across the entirety of the gap in terms of the lengthwise direction, to prevent toner leak.

Referring also to FIG. 7(*a*), the development end seals 34R and 34L are positioned at the lengthwise ends of the opening 29*d* of the development frame 29, one for one, to prevent toner from leaking from the development device 9 through the gap between the development blade 31 and development frame 29, and the gap between the development roller 6 and development frame 29. The detailed description of the structure of the development end seals 34R and 34L is given later.

The flexile sheet 35 is positioned so that it contacts the development roller 6, on the opposite side of the development roller 6 from the development blade 31 which is at the opening 29*d* of the development frame 29. It prevents toner from leaking through the gap between the development frame 29 and development roller 6. More concretely, the flexible sheet 35 is attached to the opposite lengthwise edge of the opening 29*d* of the development frame 29 from the developer delivery side (side from which toner within development frame 29 is delivered outward; downstream side in terms of rotational direction of development roller 6). The flexible sheet 35 is made of plastic film made of polyethyleneterephthalate, polyphenylene sulfide, etc., for example. It is roughly 50 μm in thickness. The flexible sheet 35 is adhered to the flexible sheet adhesion surface 29*b*1, with the use of a piece of two-sided adhesive tape or the like (FIG. 9(*a*)).

Next, referring to FIG. 7(*b*), in order to plug the gap formed by the first frame 29*a*, second frame 29*b*, development end seal 34R and flexible sheet 35, filler 60 is injected into the gap to prevent toner from leaking at the joints between the developer end seal 34R and flexible sheet 35. It is desired that the filler 60 is thermoplastic resin such as polystyrene, and is no less than 1,300 mPa·s in viscosity when it is in the melted state, for the reason that the higher in viscosity the filler 60 is when it is in the melted state, the less likely it is for the filler 60 to ooze through the gap created by the first and second frames 29*a* and 29*b*, development end seal 34R, and flexible sheet 35, when the gap is filled with the filler 60. The structural configuration for filling the gap with the filler 60 is described later.

The developer supply roller shaft seals 37R and 37L are attached to the portions of the core 33*a* of the developer supply roller 33, which are exposed outward from the development frame 29. They prevent toner from leaking through the gap between the wall of a hole 29*e* with which the development frame 29 is provided to allow the core 33*a* of the developer supply roller 33 to be put through the lateral wall of the development frame 29, and the core 33*a*.

The development device 9 is kept pressured by the compression springs (unshown) in such a manner that it is pivotally moved about the pivot (axial line b) shown in FIG. 4 in the direction (indicated by arrow mark L in FIG. 3) to keep the development roller 6 in contact with the photosensitive drum 4.

When an image is formed, the developer supply roller 33 and development roller 6 are rotationally driven while rubbing against each other. Thus, the toner in the development frame 29 is borne on the development roller 6. The development blade 31 regulates in thickness the toner layer formed on the peripheral surface of the development roller 6, and also, gives toner triboelectric charge, in she interface between itself and development roller 6, by being kept pressed upon the development roller 6. Thus, the charged toner on the development roller 6 adheres to the electrostatic latent image on the photosensitive drum 4, developing thereby the latent image, in the area of contact between the development roller 6 and photosensitive drum 4.

<<Structure of Development End Seal>>

Figure 8:
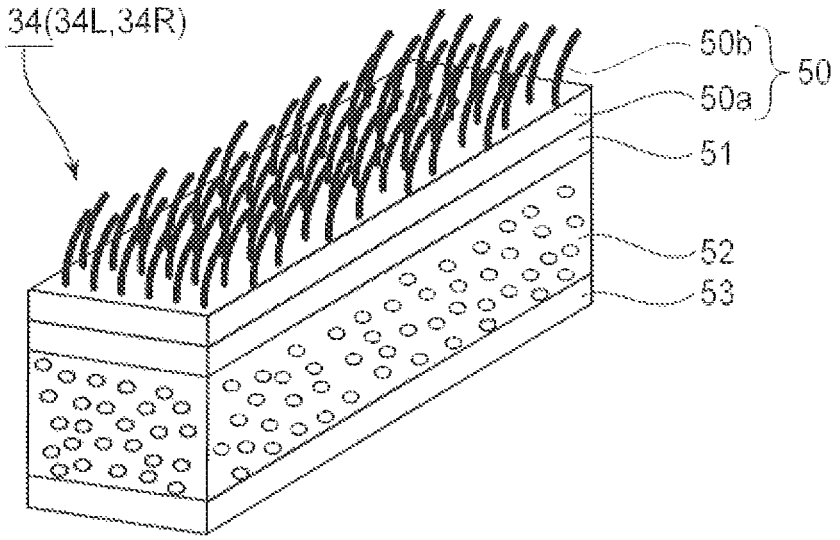
FIG. 8 is a perspective drawing of a section of the development end seal in the first embodiment, and shows in detail the structure of the development end seal.

FIG. 8 is a perspective view of an example of the development end seal 34R (and 34L). It shows the structure of the development end seal 34R in detail. The development end seals 34R and 34L are the same in structure. Hereafter, therefore, both are described as a development end seal 34.

As shown in FIG. 8, the development end seal 34 as made up of a surface layer 50, an adhesive laser 51, an intermediary layer 52, and an adhesive layer 53. The development end seal 34 is positioned between the development end seal adhesion surface 29*a*1 (FIG. 9) of the development frame 29 and the development roller 6. It has a sealing function to prevent toner leakage.

The surface layer 50 is made up of a substrative cloth 50*a* and multiple upright strands 50*b* of fiber which are implanted in the substantive cloth 50*a*. However, the surface layer 50 may be made up of the substrative cloth and multiple short strands of fiber electrostatically implanted in the substrative cloth, or the substrative cloth 50*a* alone. The surface layer 50 is attached to the surface of the intermediary layer 52 with the placement of the adhesive layer 51, for example, a piece of two-sided adhesive tape, a layer of adhesive, or the like, between the surface layer 50 and intermediary layer 52. As the material for the strands of fiber, synthetic fiber made of polyethylene, polypropylene, polyester, Nylon, acrylic resin, polyethyleneterephthalate, or the like, semi-synthetic fiber made of rayon or the like, natural fiber such as cotton, may be used. Further, the combination of the preceding materials, and the twined version of the preceding fibers, may also be listed as the material for the strands.

The intermediary layer 52 is a cushion layer formed of an elastic substance. As the material for the intermediary layer 52, a foamed version of synthetic resin such as polyurethane may be used. In this embodiment, the abovementioned filler 60 to be formed of thermoplastic resin, and the development blade bottom seal 36, are formed so that they airtightly contact the intermediary layer 52 of the development end seal 34. More specifically, the thermoplastic resin, which is kept melted at a high level of temperature, is filled into the aforementioned gap. Thus, the melted thermoplastic resin permeates into the cells of the intermediary layer 52. Thus, the development end seal 34, filler 60 formed of thermoplastic resin, and development blade bottom seal 36, are placed in contact with each other with the presence of no gap.

The adhesive layer 53 is formed of two-sided adhesive tape, pressure sensitive adhesive, or the like. The material for the adhesive layer 53 may be other material than the abovementioned ones, as long as it allows the adhesive layer 53 to be flexible and is adherent enough to ensure that the adhesive layer 53 remains adhered to the intermediary layer 52.

As for the shape of the development end seal 34, it may be different from the one in this embodiment. For example, a part or parts of the development end seal may be carved away to make the shape of the development end seal 34 conform to the shape of the development end seal adhesion surface 29*a*1, and the structure of the adjacencies of the surface 29*a*1.

<<Structure of Development Frame>>

Next, referring to FIGS. 1(*a*), 1(*b*), 9(*a*), 9(*b*) and 10, the filler 60, first frame 29*a*, and second frame 29*b* are described about their structure. Since the development end seals 34R and 34L are the same in structure, only the development end seal 34R is described here. Further, the outward and inward sides of the development end seal 34R, which constitute the wall of the passage through which the filler 60 flows, are one same in structure. Therefore, only the outward side (which corresponds to drive side bearing 38) of the development end seal 34R is described.

Figure 1B:
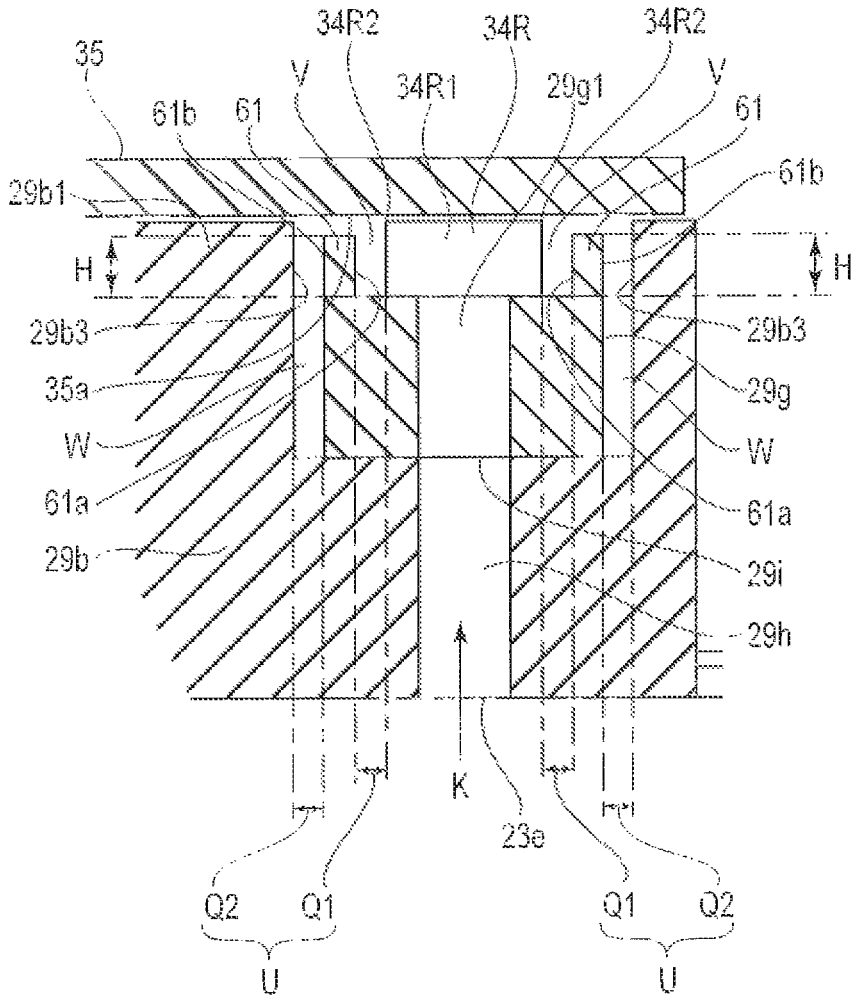
Figure 10:
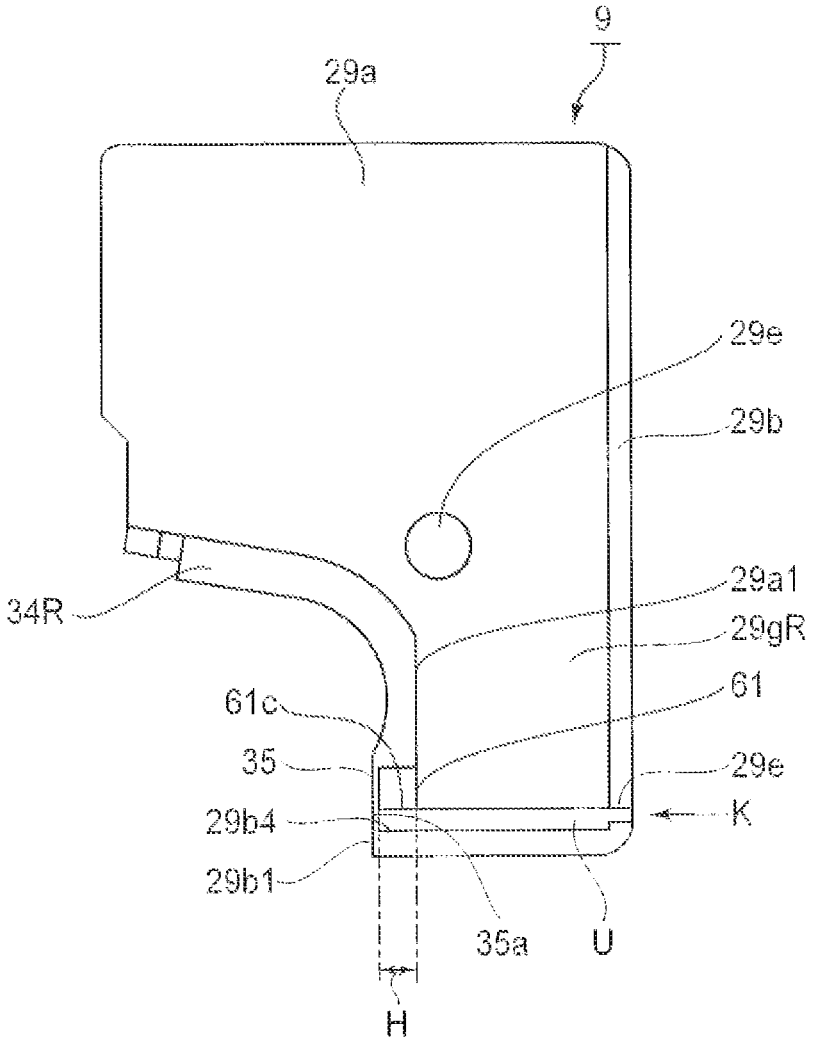
FIG. 10 is a schematic sectional view of the development device in this first embodiment.

FIG. 1A is an enlarged view of the end portion of the development frame 29 of the development device 9 in this embodiment, as seen from above (in terms of direction perpendicular to flexible sheet 35 adhesion surface 29*b*1, prior to the attachment of development roller 6. FIG. 1B is a sectional view of the same end portion of the development frame 29 as the one shown in FIG. 1A, at a plane A-A in FIG. 1A, as seen from the direction which is parallel to the flexible sheet 35 adhesion surface 29*b*1 and perpendicular to the surface 34R1 of the development end seal 34R. FIG. 10 is a schematic sectional view of the development device 9 in this embodiment.

First, the first and second frames 29*a* and 29*b* are described about their structure. As described above, the development frame 29 is made by welding the first and second frames 29*a* and 29*b* to each other by ultrasonic welding.

Referring to FIG. 9(*a*), the first frame 29*a* has the surface 29*a*1 to which the development end seal 34R is adhered. When adhering the development end seal 34R to the surface 29*a*1 of the first frame 29*a*, tins errors which occur to the development end seal 34R in its width N (dimension in terms of lengthwise direction of development end seal 34R) darting the manufacture of the development end seal 34R, errors which occur to the surface 29*a*1 in its width m during the manufacture of the first frame 29*a*, and errors which occur during the adhesion of the development end seal 34R, have to be taken into consideration. Thus, in order to prevent the problem that as the development end seal 34R is adhered to the surface to 29*a*1, it extends beyond the edges of the surface 29*a*1, the width M of the surface 29*a*1 is made greater than the width N of the development end seal 34R, by twice the width Q1 (FIGS. 1(*a*) and 1(*b*)).

Further, the first frame 29*a* is provided with a pair of protrusions 61 (61*a* and 61*b*), which are integral parts of the first frame 29*a*. The protrusions 61 are shaped and positioned so that as the development device 9 is assembled, they will be next to the development end seal 34R, on both sides of the development end seal 34R in terms of the lengthwise direction of the development roller 6, and on the upstream side of the development end seal 34R in terms of the rotational direction of the development roller 6. The width R of each protrusion 61 in terms of the lengthwise direction is sufficient for the protrusion 61 to be formed by molding, and also, for the protrusion 61 to be thick enough not to be deformed and/or broken by the pressure which is applied when the filler 60 is injected. This process of injecting the filler 60 is described later. Further, the height H (distance by which protrusion 61 protrudes from surface 29*a*1 (FIGS. 1(*a*) and 10)) of the protrusion 61, is set so that as the first and second frames 29*a* and 29*b* are joined to each other, its tip will be below the flexible sheet adhesion surface 29*b*1 (FIG. 10), for the following reason. That is, if the protrusion 61 extends beyond the surface 29*b*1, the flexible sheet 35 deforms, becoming wavy, as it is pasted to the surface 29*b*1. Thus, it is possible for the flexible sheet 35 to unevenly contact the development roller 6, making it possible for the toner leakage to occur. Incidentally, the surface 29*b*2, that is, the surface to which the flexible sheet 35 is to be adhered is an integral part of the second frame 29*b*.

The frame 29*a* is provided with a pair of seal supports 29*g* (29*g*R and 29*g*L), which protrude from the lengthwise ends of the first frame 29*a* in the direction perpendicular to the lengthwise direction. The surface 29*a*1 to which the development end seal 34R is adhered is a part of this seal support 29*g*. The second frame 29*b* is provided with a pair of recesses 29*b*2 in which the end portion of the seal support 29*g* of the first frame 29*a* fits. The recess 29*b*2 is deep enough for a gap to be left between the end of the seal support 29*g* and the bottom of the recess 29*b*2 after the fitting of the seal support 29*g* into the recess 29*b*2. The width T of the recess 29*b*2 is set in consideration of the errors in the welding of the first and second frame 29*a* and 29*b* to each other, the manufacture errors in the width N of the seal adhesion surface 29*a*1. More concretely, the width T is set so that as the first and second frames 29*a* and 29*b* are joined to each other, a gap which is Q2 in width, is formed between the lateral surfaces of the end portion of the seal support 29*g*, and the corresponding lateral surfaces of the recess 29*b*1 (FIG. 1A). That is, the width T is greater than the corresponding dimension of the surface 29*a*1 or the width M of the seal support 29*g*, by twice the width Q2.

It is after the joining of the first and second frames 29*a* and 29*b* to each other that the development end seal 34R is pasted to the surface 29*a*1 while being bend so that it conforms in shape to the peripheral surface of the development roller 6. Then, the flexible sheer 35 is pasted to the adhesion surface 29*b*1. Here, a part of the flexible sheet 35 overlaps with a part of the development end seal 34R in terms of the direction perpendicular to the area of contact between the flexible sheet 35 and development roller 6. More concretely, the lengthwise direction of the flexible sheet 35 is perpendicular to the lengthwise direction of the development end seal 34R, and the end portion of the flexible sheet 35 overlaps with the top surface of the end portion of the development end seal support 29*g*.

<<Structure of Filler Passage>>

Figure 11A:
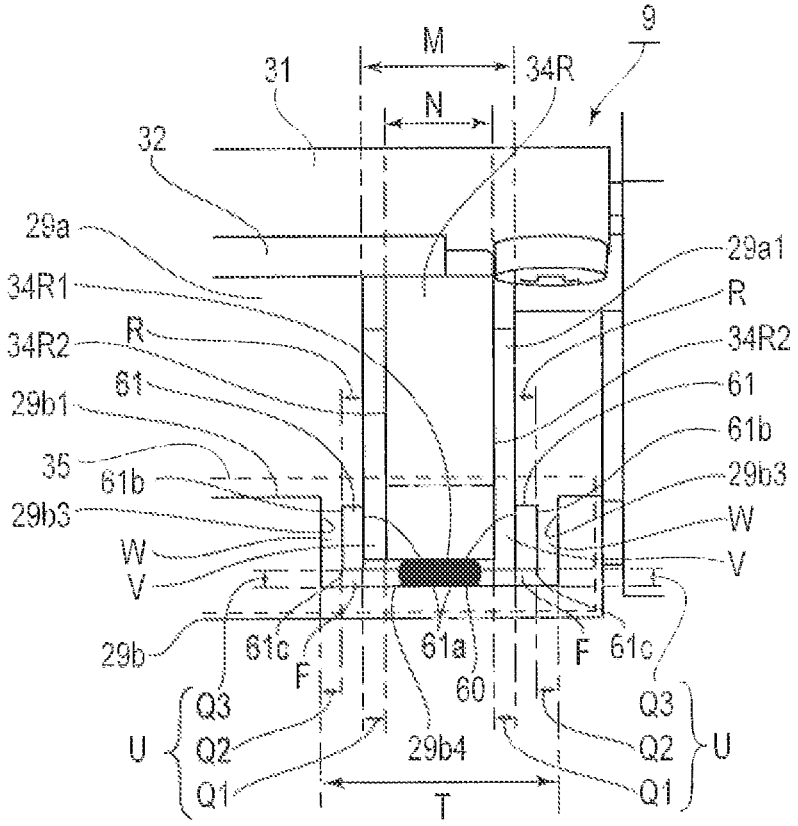
FIGS. 11A, 11B and 11C are enlarged views of the one of the lengthwise end portions of the frame of the development device in the first embodiment.
Figure 11B:
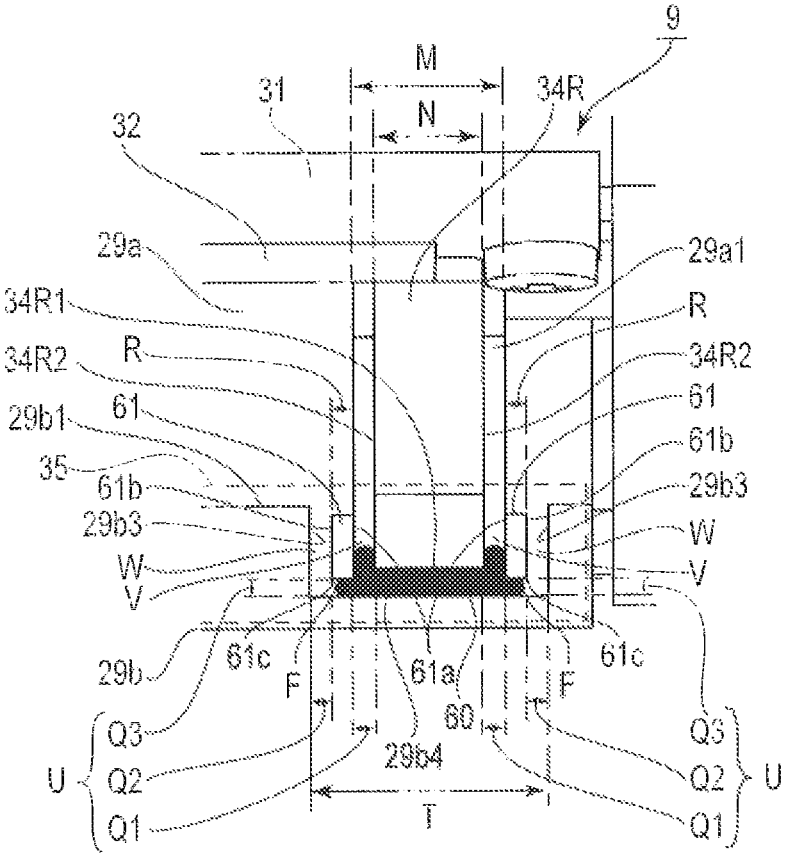
Figure 11C:
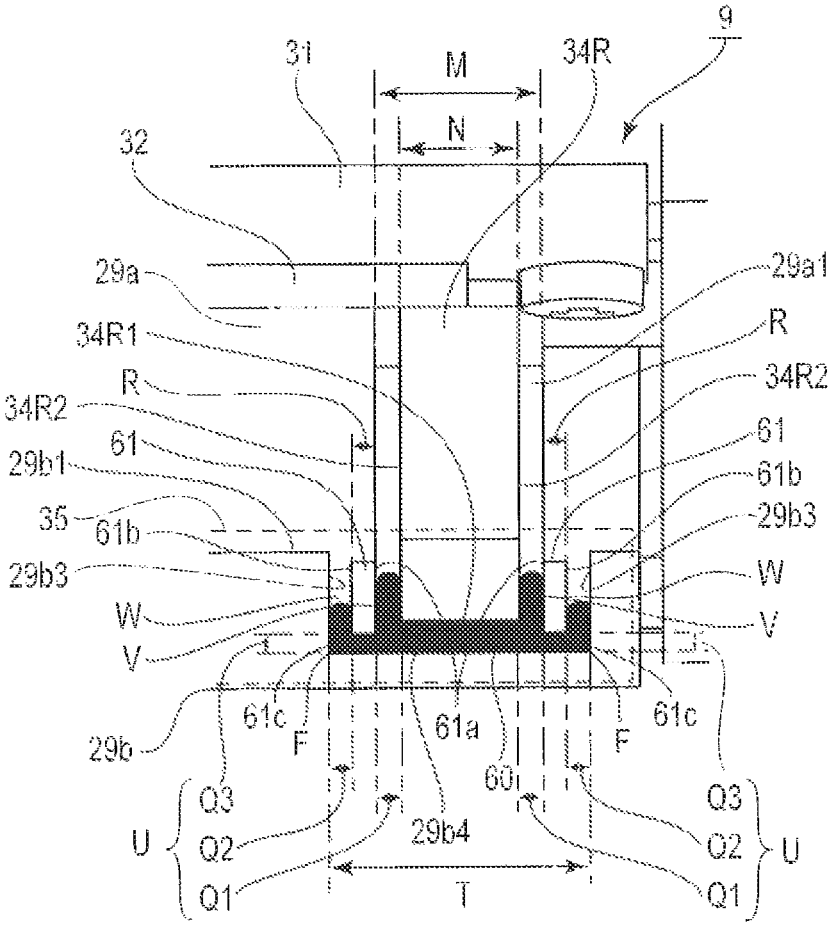
Figure 12:
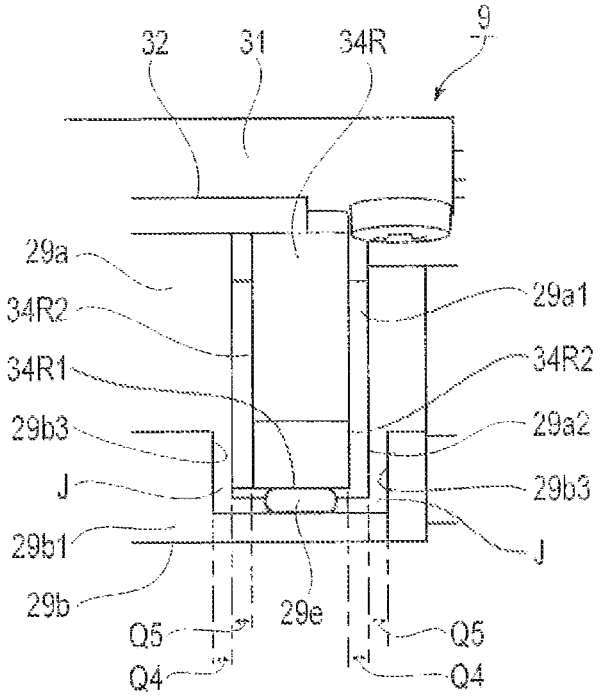
FIG. 12 is an enlarged view of the one of the lengthwise end portions of the frame of a development device in accordance with the prior art, which is comparable to the development device in accordance with the present invention.
Figure 12:
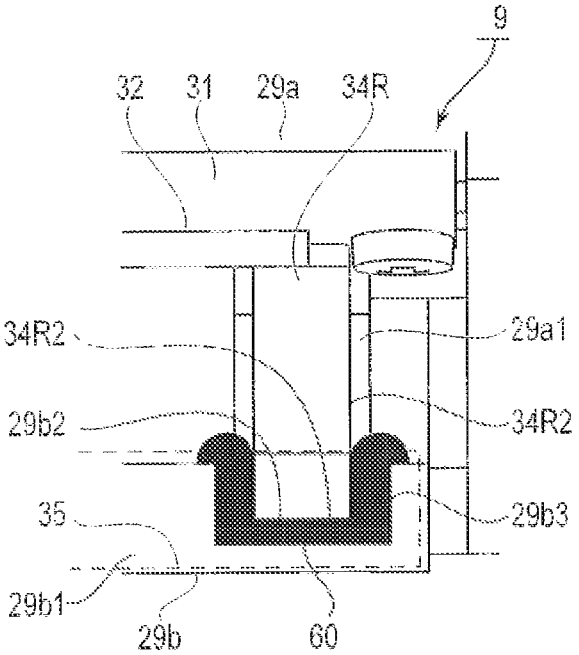

Next, referring to FIGS. 1(*a*), 11(*a*), 11(*b*), 11(*c*), 12(*a*) end 12(*b*), the structure of the passage through which the filler 60 flows is described. FIG. 11A is an enlarged view of one of the lengthwise end portions of the frame 29 of the development device 9 in this embodiment immediately after the starting of the injection of the filler 60. FIG. 11B is an enlarged view of one of the lengthwise end portions of the frame 29 of the development device 9 in this embodiment immediately after the filler 60 began to flow into its passage in the development device 9. It shows how the filler 60 flows through its passage. FIG. 11C is an enlarged view of one of the Lengthwise end portions of the frame 29 of the development devise 9 in this embodiment after the injected filler 60 hardened. FIG. 12(*a*) is an enlarged view of one of the lengthwise end portions of the frame 29 of a conventional development device 9 comparable to the development device 9 in this embodiment. It shows the structure of the filler passage of the conventional development device 9, after the injected filler 60 hardened.

Referring to FIG. 1, there is formed a space which is to be filled with the filler 60, below the area in which the flexible sheet 35 pasted to the surface 29*b* of the second frame 29*b* overlaps with the development end seal 34R pasted to the development end seal adhesion surface 29*a*1 of the first frame 29*a*. The space is surrounded by the end portion of the seal support 29*g* of the first frame 29*a*, lateral surfaces of the recess 29*b* of the second frame 29*b*, end portion (having surface 34R1) of the development end seal 34R, and a part of the bottom surface of the flexible sheet 35. The second frame 29*b* is provided with a filler injection hole 29*h* which extends from the bottom surface of the second frame 29*b* to the end seal supporting surface of the seal support 29*g* of the first frame 29*a*. The opening 29*e* of the filler injection hole 29, which is at the bottom surface of the second frame 29*b* is the opening through which the filler 60 is injected into the filler space in the frame 29. The end surface of the seal support 29*g* of the first frame 29*a* is presided with a groove 29*g*1, which is the filler guiding groove, and which is shaped so that the shape of the groove 29*g*1 matches that of the filler injection hole 29*h*.

The space which is surrounded by the first and second frames 29*a* and 29*b*, and development end seal 34R, and extends from the opening 29*e* or the filler injection hole 29*h* to the space is the filler passage U, that is, the space to be completely occupied by the filler 60 after the hardening of the filler 60 made up of resinous substance.

The heated filler 60 is injected into the filler passage U in the direction indicated by an arrow mark K through the opening 29*e* which is at the bottom surface of the second frame 29*b*, to fill the filler passage U (FIG. 10). First, the filler 60 fills the adjacencies of the opening 29*e*, and then, gradually advances in the direction indicated by the arrow mark K while filling the passage U.

After flowing into the filler passage U through the opening 29*e* of the filler injection hole 26*h*, the filler 60 flows into the gap between the bottom surface 29*b*4 of the recess 29*b*2, and the end surface of the seal support 29*g*. This gap between the bottom surface 29*b* and the end surface of the seal support 29*g* is wider because of the presence of the groove 29*g*1. Therefore, the filler 20 flows between the bottom surface 29*b*4 and the end surface of the a seal support 29*g* along the groove 29*g*1, being guided toward the upstream surface 34R1 of the development end seal 34R in terms of the rotational direction of the development roller 6 (as indicated by arrow mart K in FIG. 1B).

There is the flexible sheet 35 above the upstream surface 34R1, preventing thereby the filler 60 from flowing beyond the upstream surface 34R1, Therefore, as the filler 60 flows to the upstream surface 34R1 along the groove 29*g*1, a part of the filler 60 flows to the bottom surface 35*a* of the flexible sheet 33 (opposite surface of flexible sheet 33 from area of contact between flexible sheet 35 and development roller 6), and flows along the bottom surface 35*a*, toward both lengthwise ends of the upstream surface 34R1. The rest of the filler 60 flows into the narrow spaces between the bottom surface 29*b*4 and the end surface of the seal support 29*g*, which are on the both sides of the groove 29*g*1, while being guided by the groove 29*g*1 in the direction indicated by the arrow mark K. That is, the filler 60 gradually fills between the bottom surface 29*b*4 and end surface of the seal support 29*g*. Eventually, the filler 60 fills the aforementioned gaps, the width of which are Q1 and Q2, respectively, ending the filling of the gaps (filler passages) (FIGS. 11(*b*) and 11(*c*)). How the filler 60 flows into the gaps having the widths of Q1 and Q2, respectively, is described later in detail.

As described above, as the development device 9 is assembled, the gap which is Q1 in width is created between the development end seal 34R pasted to the seal adhesion surface 29*a*1, and the protrusion 61. This gap is the first section V of the filler passage U. That is, the first section V is the space crested by the two surfaces 34R2 of the end portion of the development end seal 34R in terms or the lengthwise direction, and the lateral surfaces 61*a* of the protrusion 61, which are parallel to the lengthwise direction. The second section F of the filler passage U is the gap which is between the lateral surface 61*c* of the upstream portion of the protrusion 61 in terms of the rotational direction of the development roller 6, and the bottom surface 29*b*4 of the recess 29*b*2, and which is Q3 in width. Further, the gap between the first and second frames 29*a* and 29*b*, which is Q2 in width, is the third section W of the filler passage U. The third section W is created by the lateral surface 29*b*3 of the recess 29*b*2 of the second frame 29*b*, the lateral surface 61*b* (which includes lateral surfaces of the seal support 29*g* of first frame 29*a*) of the protrusion 61, which is parallel to the lengthwise direction, and faces the lateral surface 29*b*3 (FIG. 1A).

FIG. 12 is a drawing which shows the structure of one of the lengthwise end portions of the development frame of an example of a conventional development device which, is comparable to the development device 9 in this embodiment. Unlike the development device 9 in this embodiment, the comparative development device is not provided with the protrusions 61. In the case of the comparative development device, the passage J for the filler 60 is created by the lateral surfaces 29*b*3 of the recess 29*b*2 of the second frame 29*b*, the lateral surfaces 29*g*2 (which are parallel, to lengthwise direction of seal support 29*g*) of the seal support 29*g* of the first frame 29*a*, and lateral surfaces 34R2 (which are parallel to development end seal 34R) of the development end seal 34R. That is, the passage J is made up of the gap between the lateral surface 34R2 and lateral surface 29*a*2 (edge of surface 29*a*1), which is Q4 in width in terms of lengthwise direction, and the gap between the lateral surface 29*a*2 and lateral surface 29*b*3, which is Q5 in width in terms of lengthwise direction (J in FIG. 12(*a*)).

Regarding the errors in the width N of the development end seal 34R in terms of the lengthwise direction, which occur during the manufacture of the development device 9, the assembly errors which occur when the development end seal 34R is pasted, and the error in the width id of the development end seal adhesion surface 29*a*1 of the first frame 29*a*, which occur during the manufacture of the development device 9, the development device 9 in this embodiment and comparative development device are the same. Therefore, the width Q1 of the gap between the lateral surface 34R2 of the development end seal 34R in this embodiment, and the width Q3 of the gap between the lateral surface 34R2 of the development end seal 34R, and the lateral surface 29*a*2 of the seal support 29*g*, in the comparative development device, are the same (Q1=Q3). Similarly, the width Q2 of the gap between the lateral surface 61*b* of the protrusion 61 and the lateral surface 29*b*3 of the recess 29*b*, in the development device 9 in this embodiment, are the same as the width Q5 of the gap between the lateral surface 29*a*2 of the seal support 20*g* and the lateral surface 29*b*3 of the recess 29*b*, in the comparative development device (Q2=Q5). In the case of the comparative development device, the relationship among the various sections in terms of their width is: Q4+Q5>Q1; and Q4+Q5>Q2. In other wards, the comparative development device is greater in the width of the filler passage than the development device 9 in this embodiment.

Shown in FIGS. 11(*b*) and 11(*c*) are how the filler 60 flows into the first, second and third sections V, F and W of the filler passage as the filler is injected into the filler passage of the development device 9 in this embodiment. As described above, the heated filler 60 is injected from the opening 29*e* shown in FIG. 10, and then, flows toward the upstream surface 34R1 of the development end seal 34R in terms of the rotational direction of the development roller 6 (FIG. 11A). Then, the filler 60 flows info the first and second sections V and F (FIG. 11B). Then, the filler 60 hardens after filling the first, second, and third sections V, F, and W. That is, the filler passage U created by the first and second frame 29*a* and 29*b*, development end seal 34R, and flexible sheet 35 is filled with the hardened filler 60 (FIG. 11C). In the case of this embodiment, the filler 60 does not ooze beyond the flexible sheet 35, and therefore, does not come into contact with the development roller 6. In FIG. 11C, the contour of the flexible sheet 35 is indicated by a broken line.

In comparison, in the case of the comparative development device, it is possible that as the filler 60 flows into the section J of the filler passage (U) from the direction of the upstream surface 34R1 of the development end seal 34R in terms of the rotational direction of the development roller 6, it will overflow from the section J, ooze beyond the flexible sheet 35, and harden (FIG. 12(*b*)), which is problematic. In FIG. 12(*b*), the contour of the flexible sheet 35 is indicated by a broken line. The reason why this problem occurs is as follows. That is, the width (Q4+Q5) of the section J of the filler passage in the comparative development device is greater than the width Q1 of the first section V, and the width Q2 of the third section W, of the filler passage in this embodiment. Therefore, the filler 60 is more likely to flow into the first section J of the filler passage in the comparative development device than that in this embodiment. If the development roller 6 is attached to the development frame 29 which is in the state described above, it is possible that the filler 60 will come into contact with the development roller 6, which in turn will cause the image forming apparatus 1 to output an unsatisfactory image.

In the case of the development device 9 in this embodiment, the pair of protrusions 61 are positioned on both sides of the developer end seal adhesion surface 29*a*1, one for one. Therefore, the filler passage (which is to be filled with filler 60) is divided into narrow sections. Therefore, even if the pressure applied to inject the filler 60 is substantial, and also, the amount by which the filler 60 is to be injected is substantial, for example, even if the filler 60 is injected in a single step by the amount necessary to fill the gaps, it is possible so prevent the filler 60 from oozing beyond the flexible sheet 35, and therefore, it is possible to prevent the image forming apparatus 1 from outputting an unsatisfactory image.

As described above, one of the characteristic features of this embodiment of the present invention is that the pair of protrusions 61 are positioned on both sides of the development end seal adhesion surface 29*a*1 of the development end seal 34R. Further, the passage for the filler 60 is divided into the first section V created by the lateral surface 34R2 of the development end seal 34R, lateral surface 61*a* of the protrusion 61, and the third section W created by the lateral surface 61*b* of the protrusion 61 and the lateral surface 29*b*3 of the second frame 29*b*. In other words, the passage for the filler 60 is divided into narrower passages to prevent the filler 60 from oozing beyond the flexible sheet 35. Therefore, it is possible to provide a cartridge which does not cause an electrophotographic image forming apparatus to output an unsatisfactory image.

Incidentally, the above described embodiment of the present invention is not intended to limit the present invention in terms of the structure of the protrusion 61. For example, the development device 9 may be structured so that the portion of the protrusion 61, which is on the lateral surface 61*c* side, extends into the gap between the end surface 34R1 of the development end seal 34R and the bottom surface 29*b*4 of the recess 29*b*2. With the employment of this configuration, it is possible to more efficiently guide the filler 60 onto the first and second sections V and F of the filler passage. That is, this configuration is greater than the configuration in this embodiment in terms of the effect of preventing the filler 60 from oozing beyond the flexible sheet 35.

As tor the positioning of the opening 29*e* for filler injection, it does not need to be limited to the bottom surface of the second frame 29*b*. For example, it may be at the lateral surface of the second frame 29*b* that the opening 29*e* is provided.

EFFECTS OF INVENTION

As described above, according to the present invention, it is possible to improve a developing device in terms of the level of perfection at which the gaps between the development apparatus (device) frame and the development end seals of the development apparatus (device), and the gap between the development apparatus (device) frame and flexible sheet of the apparatus (device) are filled with filler.

While the invention has been described with reference to the exemplary embodiments, it is to be understood that the invention is not limited to the disclosed exemplary embodiments. The scope of the following claims is to be accorded the broadest interpretations as to encompass all such modifications and equivalent structures and functions.

This application claims priority from Japanese Patent Application No. 201852/2012 filed Sep. 13, 2012, which is hereby incorporated by reference.

What is claimed is:

1. A developing device for use with an image forming apparatus, said developing device comprising:

a frame including a first frame and a second frame;

a developer accommodating portion for accommodating developer, said developer accommodating portion being formed by said frame;

a developer carrying member for developing a latent image formed on an image bearing member using the developer accommodated in said developer accommodating portion;

an end portion sealing member, provided on said first frame, for sealing between an end portion of said developer carrying member and said frame with respect to a rotational axis direction of said developer carrying member to prevent leakage of the developer from said developer accommodating portion;

a sheet, provided on said second frame in contact with said developer carrying member along the rotation axis direction of said developer carrying member, for preventing leakage of the developer from said developer accommodating portion;

a filler for preventing leakage of the developer from said developer accommodating portion, said filler filling a space defined by said frame, said end portion sealing member, and said sheet; and a projected portion provided in said first frame and projected toward the space, said projected portion being spaced from said second frame and said end portion sealing member in the rotational axis direction, wherein said filler is provided between said end portion sealing member and said projected portion, and wherein said space includes a first flow path for permitting said filler to be filled between said projected portion and said end portion sealing member with respect to the rotational axis direction, a second flow path for permitting said filler to be filled between said projected portion and said second frame with respect to a direction perpendicular to the rotational axis direction, and a third flow path for permitting said filler to be filled between said projected portion and said second frame with respect to the rotational axis direction.

2. The developing device according to claim 1, further comprising a filling port for permitting said filler to be filled into the space from an outside of said developer accommodating portion.

3. The developing device according to claim 2, wherein said filling port is provided in said frame.

4. The developing device according to claim 2, further comprising a guide portion for directing said filler into the space from said filling port.

5. The developing device according to claim 4, wherein said guide portion includes a groove provided in said frame.

6. The developing device according to claim 1, wherein said first frame is provided with a supporting portion projected in a direction perpendicular to the rotational axis direction and supporting said end portion sealing member, and said second frame is provided with a cut-away portion into which said supporting portion enters so as to provide the space, said cut-away portion being provided in a part of a surface to which said sheet is stuck.

7. The developing device according to claim 1, wherein said projected portion is provided at each of opposite sides of said end portion sealing member with respect to the rotational axis direction.

8. The developing device according to claim 1, wherein said filler is made of a resin material having a viscosity not less than 1300 mPa·s.

9. A process cartridge detachably mountable to a main assembly of an image forming apparatus, said process cartridge comprising:

an image bearing member;

a frame including a first frame and second frame;

a developer accommodating portion for accommodating developer, said developer accommodating portion being formed by said frame;

a developer carrying member for developing a latent image formed on said image bearing member using the developer accommodated in said developer accommodating portion;

an end portion sealing member, provided on said first frame, for sealing between an end portion of said developer carrying member and said frame with respect to a rotational axis direction of said developer carrying member to prevent leakage of the developer from said developer accommodating portion;

a sheet, provided on said second frame in contact with said developer carrying member along the rotational axis direction of said developer carrying member, for preventing leakage of the developer from said developer accommodating portion;

a filler for preventing leakage of the developer from said developer accommodating portion, said filler filling a space defined by said frame, said end portion sealing member, and said sheet; and a projected portion provided in said first frame and projected toward the space, said projected portion being spaced from said second frame and said end portion sealing member in the rotational axis direction, wherein said filler is provided between said end portion sealing member and said projected portion, and wherein said space includes a first flow path for permitting said filler to be filled between said projected portion and said end portion sealing member with respect to the rotational axis direction, a second flow path for permitting said filler to be filled between said projected portion and said second frame with respect to a direction perpendicular to the rotational axis direction, and a third flow path for permitting said filler to be filled between said projected portion and said second frame with respect to the rotational axis direction.

10. The process cartridge according to claim 9, further comprising a filling port for permitting said filler to be filled into the space from an outside of said developer accommodating portion.

11. The process cartridge according to claim 10, wherein said filling port is provided in said frame.

12. The process cartridge according to claim 10, wherein further comprising a guide portion for directing said filler into the space from said filling port.

13. The process cartridge according to claim 12, wherein said guide portion includes a groove provided in said frame.

14. The process cartridge according to claim 9, wherein said first frame is provided with a supporting portion projected in a direction perpendicular to the rotational axis direction and supporting said end portion sealing member, and said second frame is provided with a cut-away portion into which said supporting portion enters so as to provide the space, said cut-away portion being provided in a part of a surface to which said sheet is stuck.

15. The process cartridge according to claim 9, wherein said projected portion is provided at each of opposite sides of said end portion sealing member with respect to the rotational axis direction.

16. The process cartridge according to claim 9, wherein said filler is made of a resin material having a viscosity not less than 1300 mPa·s.

17. A unit for use with an image forming apparatus, said unit comprising:

a frame including a first frame and a second frame;

a developer accommodating portion for accommodating developer, said developer accommodating portion being formed by said frame and;

a rotatable member for carrying developer;

an end portion sealing member, provided on said first frame, for sealing between an end portion of said rotatable member and said frame with respect to a rotational axis direction of said rotatable member to prevent leakage of the developer from said developer accommodating portion;

a sheet, provided on said second frame in contact with said rotatable member along the rotational axis direction of said rotatable member, for preventing leakage of the developer from said developer accommodating portion;

a filler for preventing leakage of the developer from said developer accommodating portion, said filler filling a space defined by said frame, said end portion sealing member, and said sheet; and a projected portion provided in said first frame and projected toward the space, said projected portion being spaced from said second frame and said end portion sealing member in the rotational axis direction, wherein said filler provided between said end portion sealing member and said projected portion, and wherein said space includes a first flow path for permitting said filler to be filled between said projected portion and said end portion sealing member with respect to the rotational axis direction, a second flow path for permitting said filler to be filled between said projected portion and said second frame with respect to a direction perpendicular to the rotational axis direction, and a third flow path for permitting said filler to be filled between said projected portion and said second frame with respect to the rotational axis direction.

18. The unit according to claim 17, further comprising a filling port for permitting said filler to be filled into the space from an outside of said developer accommodating portion.

19. The unit according to claim 18, wherein said filling port is provided in said frame.

20. The unit according to claim 18, further comprising a guide portion for directing said filler into the space from said filling port.

21. The unit according to claim 20, wherein said guide portion includes a groove provided in said frame.

22. The unit according to claim 17, wherein said first frame is provided with a supporting portion projected in a direction perpendicular to the rotational axis direction and supporting said end portion sealing member, and said second frame is provided with a cut-away portion into which said supporting portion enters so as to provide the space, said cut-away portion being provided in a part of a surface to which said sheet is stuck.

23. The unit according to claim 17, wherein said projected portion is provided at each of opposite sides of said end portion sealing member with respect to the rotational axis direction.

24. The unit according to claim 17, wherein said filler is made of a resin material having a viscosity not less than 1300 mPa·s.

* * * * *